US011029016B2

(12) United States Patent
Bryant

(10) Patent No.: US 11,029,016 B2
(45) Date of Patent: Jun. 8, 2021

(54) LIGHTED DISPLAY SYSTEM WITH INTERCHANGEABLE COVER ELEMENT FOR A HAT

(71) Applicant: Holicap, Inc., Deerfield Beach, FL (US)

(72) Inventor: Travis Anton Bryant, Fort Lauderdale, FL (US)

(73) Assignee: Holicap, Inc., Deerfield Beach, FL (US)

( * ) Notice: Subject to any disclaimer, the term of this patent is extended or adjusted under 35 U.S.C. 154(b) by 0 days.

(21) Appl. No.: 16/835,825

(22) Filed: Mar. 31, 2020

(65) Prior Publication Data

US 2020/0355361 A1 Nov. 12, 2020

Related U.S. Application Data

(60) Provisional application No. 62/920,632, filed on May 10, 2019.

(51) Int. Cl.

| | |
|---|---|
| ***F21V 33/00*** | (2006.01) |
| ***F21K 9/237*** | (2016.01) |
| ***F21K 9/238*** | (2016.01) |
| ***F21K 9/235*** | (2016.01) |
| *F21W 121/06* | (2006.01) |
| *F21Y 115/10* | (2016.01) |

(52) U.S. Cl.

CPC ..... *F21V 33/0008* (2013.01); *F21K 9/235* (2016.08); *F21K 9/237* (2016.08); *F21K 9/238* (2016.08); *F21W 2121/06* (2013.01); *F21Y 2115/10* (2016.08)

(58) Field of Classification Search

CPC .... F21V 33/0008; F16F 1/3732; F21K 9/235; F21K 9/237; F21K 9/238; G09F 21/023; A42B 3/04; A42B 1/244

See application file for complete search history.

(56) References Cited

U.S. PATENT DOCUMENTS

| | | | |
|---|---|---|---|
| 5,111,366 | A | 5/1992 | Rife et al. |
| 5,239,450 | A | 8/1993 | Wall |
| 5,278,734 | A | 1/1994 | Ferber |
| 5,509,144 | A | 4/1996 | Soergel et al. |
| 5,680,718 | A | 10/1997 | Ratcliffe et al. |
| 6,116,745 | A | 9/2000 | Yei |
| 7,611,255 | B1 | 11/2009 | Lagassey |

(Continued)

OTHER PUBLICATIONS

International Search Report and Written Opinion of the International Searching Authority for PCT/US2020/032129, dated Jul. 30, 2020, pp. 1-9.

*Primary Examiner* — Joseph L Williams
*Assistant Examiner* — Jacob R Stern
(74) *Attorney, Agent, or Firm* — The Concept Law Group, PA; Scott D. Smiley; Scott M. Garrett

(57) ABSTRACT

A lighting system for a hat includes a front housing containing lighting elements that mates with a back plate positioned on the inside of the hat. Driver circuitry controls operation of the LEDs for various lighting modes, and a cover for the front housing is translucent and designed in the shape of a recognizable logo or other design. Electric power comes from a battery located on the back plate, and is provided through the hate using prongs or projections that pass through the hat, from the back plate to a circuit connector in the front housing. The circuit connector is electrically coupled to circuitry on a circuit board in the front housing.

15 Claims, 16 Drawing Sheets

(56) References Cited

U.S. PATENT DOCUMENTS

| | | | |
|---|---|---|---|
| 7,699,485 | B1 | 4/2010 | Lagassey |
| 7,824,053 | B2 | 11/2010 | Maier, Sr. |
| 8,425,072 | B2 | 4/2013 | Hurwitz |
| 8,869,312 | B2 | 10/2014 | Tuohy et al. |
| 9,526,287 | B2 | 12/2016 | Waters |
| 9,669,292 | B1 | 6/2017 | Warner et al. |
| 2004/0093658 | A1 | 5/2004 | Jackson |
| 2010/0313334 | A1 | 12/2010 | Moy |
| 2014/0304891 | A1 | 10/2014 | Waters |
| 2017/0347733 | A1 | 12/2017 | Durand, Jr. |
| 2018/0049500 | A1 | 2/2018 | Richardson |
| 2018/0317584 | A1 | 11/2018 | Win |

LIGHTED DISPLAY SYSTEM WITH INTERCHANGEABLE COVER ELEMENT FOR A HAT

CROSS REFERENCE

This application claims the benefit of U.S. provisional application No. 62/920,632, filed May 10, 2019, the entirety of which is hereby incorporated by reference.

FIELD OF THE INVENTION

The present invention relates generally to illuminated displays, and, more particularly, relates to a lighted display system for a hat which allows changing of a cover that is translucent, which allows a variety of covers to be made with different designs that can be placed on the system and illuminated.

BACKGROUND OF THE INVENTION

The so called "baseball" cap is likely the most popular style of hat in the United States, and includes a simple head covering portion and a front brim that is roughly about as wide as a person's face and which extends forward about three to four inches. These hats almost always have some type of logo, design, or other indicia on the front of the head cover, centered over the brim. It is common to have, for example, logos for sports teams, companies, universities, and so on, on baseball caps. People enjoy wearing caps with particular logos or designs on them.

At the same time, the use of lighting to illuminate features on hats has long been a popular novelty. People have made lighted elements for caps in the past. However, many of these had designs that could not be changed. Since people enjoy wearing different caps, it follows that people would want to change the design on an illuminated cap. It is also true that manufacturing different light assemblies with different static designs is inefficient.

Therefore, a need exists to overcome the problems with the prior art as discussed above.

SUMMARY OF THE INVENTION

In accordance with some embodiments of the inventive disclosure, there is provided a light assembly for a hat. The light assembly has a changeable display element that is illuminated by the light assembly, and includes a back plate configured to be mounted inside the hat. The back plate includes a first side and a second side, a plurality of conductive prongs extending from the first side, and a driver circuit board disposed on the second side that is electrically connected to at least two of the plurality of prongs. The light assembly further includes a front housing having a back wall and a sidewall extending forward from the back wall. The sidewall defines a front window and front edge at a forward perimeter of the side wall. The sidewall and the back wall define an interior space. The front housing also includes a plurality of prong receptacles formed in the interior space, each one of the prong receptacles defining a channel through the back wall that is configured to receive a corresponding one of the plurality of conductive prongs and has a conductive contact configured to make electrical contact with a received conductive prong passing into the channel. A light circuit board is disposed in the interior space adjacent the back wall and has a light emitting element disposed thereon. The light emitting element is electrically connected to at least two of the prong receptacles. The light assembly further includes a cover retention feature at the front edge of the side wall configured to retain a cover over the window.

In accordance with a further feature, the plurality of conductive prongs and the plurality of prong receptacles are configured such that when the back plate and front housing are aligned and pressed together, with each of the plurality of conductive prongs passing into a respective one of the plurality of prong receptacles, a distal end of each of the plurality of prongs extends beyond an exit of the respective one of the prong receptacles, and wherein the conductive contact of each prong receptacle is located at the exit, and wherein electrical contact is made by bending the distal end of each of the conductive prongs into contact with the electrical contact.

In accordance with a further feature, the light assembly further includes at least one support prong extending from the first side of the back plate that interfaces with a prong receptacle in the front housing at an opening at the back wall of the front housing.

In accordance with a further feature, the light assembly further includes a switch electrically coupled to the driver circuit that is operable to activate and deactivate the driver circuit, the switch being coupled by wires that allow the switch to be remotely located in the hat from the driver circuit.

In accordance with a further feature, the light assembly further includes a pad that is configured to cover the driver circuit.

In accordance with a further feature, the light assembly further includes a rigid cover that is disposed over the driver circuit.

In accordance with a further feature, the back plate is curved.

In accordance with a further feature, each of the prong receptacles includes a retaining clip disposed in a slot in the prong receptacle, the retaining clip being conductive and having a bottom end that extends into the channel so as to be in contact with the respective conductive prong.

In accordance with some embodiments of the inventive disclosure, there is provided a light assembly for a hat that includes a back plate configured to be mounted inside the hat. The back plate has a plurality of conductive prongs extending from a first side of the back plate and a power course electrically coupled to two of the plurality of conductive prongs. The light assembly further includes a front housing having a back wall, and a sidewall extending forward from the back wall. The sidewall defines a front window and front edge at a forward perimeter of the side wall, and the sidewall and the back wall define an interior space. The light assembly further includes a light circuit board disposed in the interior space adjacent the back wall and has a light emitting element disposed thereon. The light circuit board further includes a plurality of prong receptacles, with each one of the prong receptacles defining an opening through the light circuit board that is configured to receive a corresponding one of the plurality of conductive prongs and having a conductive contact configured to make electrical contact with a received conductive prong passing through the opening. The light emitting element is electrically connected to at least two of the prong receptacles. The light assembly further includes a cover configured to fit over the front of the front housing that includes a translucent cover member.

In accordance with a further feature, the plurality prong receptacles include opposing reed members positioned around the respective opening for each one of the plurality of prong receptacles.

In accordance with a further feature, the plurality of conductive prongs and the plurality of prong receptacles are configured such that when the back plate and front housing are aligned and pressed together, with each of the plurality of conductive prongs passing into a respective one of the plurality of prong receptacles, a distal end of each of the plurality of prongs extends beyond an exit of the respective one of the prong receptacles, and wherein the conductive contact of each prong receptacle is located at the exit, and wherein electrical contact is made by bending the distal end of each of the conductive prongs into contact with the electrical contact.

In accordance with a further feature, the back plate comprises at least two retention holes, the front housing includes at least two retention posts at a back side of the front housing, wherein each one of the at least two retention posts is positioned to correspond with a respective one of the retention holes in the back plate.

In accordance with a further feature, each of the retention posts pass through the respective one of the retention holes and is melted over on a back side of the back plate to retain the back plate to the front housing.

In accordance with a further feature, the front housing have cover have a shape that corresponds to an outline of a logo.

In accordance with a further feature, the cover and translucent cover member are removable from the front housing.

In accordance with some embodiments of the inventive disclosure, there is provided a light assembly for a hat that includes a back plate having a plurality of conductive prongs extending from a first side of the back plate and a power course electrically coupled to two of the plurality of conductive prongs. The light assembly further includes a front housing having a back wall, a sidewall extending forward from the back wall, the sidewall defining a front window and front edge at a forward perimeter of the side wall, where the sidewall and the back wall define an interior space. The light assembly further includes a light circuit board disposed in the interior space of the front housing, where the light circuit board has a plurality of light emitting diodes (LEDs) disposed thereon. The light assembly further includes at least two prong receptacles, with each one of the prong receptacles configured to receive a corresponding one of the plurality of conductive prongs and having a conductive contact configured to make electrical contact with a conductive prong received in the prong receptacle, wherein the plurality of LEDs is electrically connected to the at least two of the prong receptacles. The light assembly further includes a cover configured to fit over the front of the front housing that includes a translucent cover member.

In accordance with a further feature, the at least two prong receptacles are disposed on the light circuit board.

In accordance with a further feature, the at least to prong receptacles comprise opposing reed members.

In accordance with a further feature, the at least two prong receptacles are formed in the interior space of the front housing and define a channel through the back wall of the front housing that is configured to receive a corresponding one of the plurality of conductive prongs, each one of the at least two prong receptacles having a conductive contact configured to make electrical contact with a received conductive prong passing into the channel.

In accordance with a further feature, the conductive contact of each prong receptacle is located at an exit of the channel, and wherein electrical contact is made by bending the distal end of each of the conductive prongs into contact with the electrical contact.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms “a” or “an,” as used herein, are defined as one or more than one. The term “plurality,” as used herein, is defined as two or more than two. The term “another,” as used herein, is defined as at least a second or more. The terms “including” and/or “having,” as used herein, are defined as comprising (i.e., open language). The term “coupled,” as used herein, is defined as connected, although not necessarily directly, and not necessarily mechanically. The term “providing” is defined herein in its broadest sense, e.g., bringing/coming into physical existence, making available, and/or supplying to someone or something, in whole or in multiple parts at once or over a period of time.

“In the description of the embodiments of the present invention, unless otherwise specified, azimuth or positional relationships indicated by terms such as “up”, “down”, “left”, “right”, “inside”, “outside”, “front”, “back”, “head”, “tail” and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as “first”, “second”, “third” and so on are only used for descriptive purposes, and cannot be construed as indicating or implying relative importance.

In the description of the embodiments of the present invention, it should be noted that, unless otherwise clearly defined and limited, terms such as “installed”, “coupled”, “connected” should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms “about” or “approximately” apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
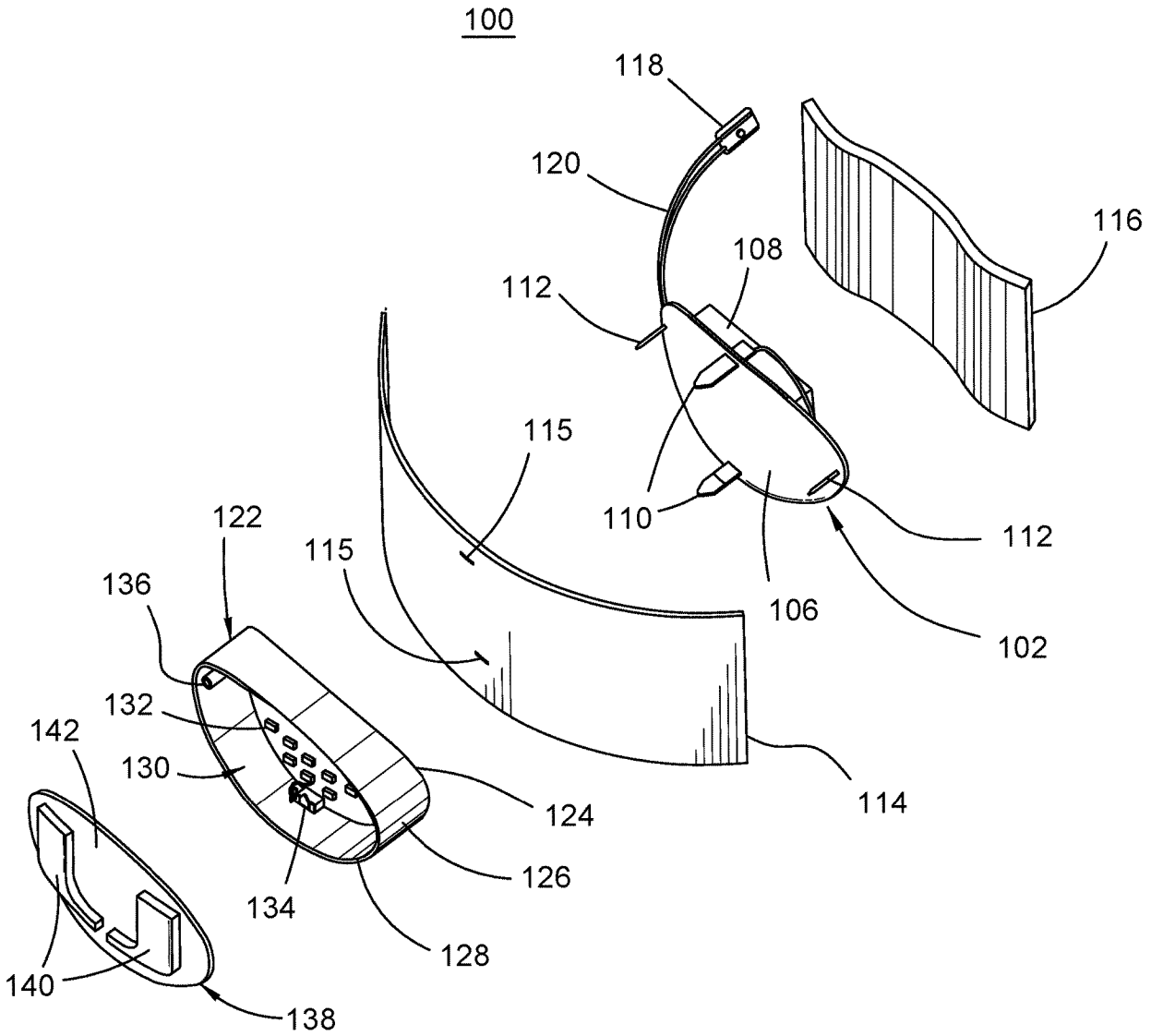
FIG. 1 is an exploded view of a lighted display system for a hat, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

FIG. 1 is an exploded view of a lighted display system 100 for a hat, in accordance with some embodiments. It will be appreciated by those skilled in the art that while the inventive disclosure is applied to a baseball cap type hat, the system 100 can be readily adapted to other styles of hats, and even other garments worn on other parts of the body, or even to fabric/textile elements that are not garments. The lighted display system allows a user to display a selected logo, graphic, or other design in a way that it is illuminated from behind. Therefore, by making the design on a translucent material, colors and shades can be achieved while also providing a noticeable light output that is different than a conventional embroidered design.

The lighting display system comprises three major portions; a back plate 102, a front housing 122, and a cover member 138. These are assembled together on a portion of a hat 114 or similar textile. The back plate 102 has a first side 106 and a second side 104 that is opposite the first side. As used here, the first and second sides 106, 104 refer to the major surfaces of the back plate 102, which is a generally plate-like member where the dimensions across the major surfaces are much greater than the thickness between them, and the major surfaces the thickness between the two major surfaces is generally consistent at any point. The back plate 102 is made of a generally rigid material that is not electrically conductive. On the second side 104 there is disposed a driver circuit 108 that can include a battery and circuit elements to regulate electric current from the battery to lighting elements in the front housing 122, as will be described. In some embodiments the back plate 102 can also be a circuit board, having conductive traces for connecting individual circuit elements as known. In some embodiments a separate circuit board is mounted on the second side 104 of the back plate 102. The back plate 102 can be curved to generally follow a curve consistent with that of a human forehead, or the front portion of a hat. A foam or similar member 116 can be placed over the driver circuit 108 and back plate 102 to protect the driver circuit 108 and provide some cushion against a wearer's head.

A plurality of conductive prongs 110 can extend from the first side 106 of the back plate 102. The conductive prongs 110 carry electric current to and from the driver circuit 108 and the lighting element in the front housing 122. Additionally, there can be one or more stabilizing prongs 112 which do not carry current and are not connected to the driver circuit 108 or any other circuit, but which help to mechanically stabilize the assembly 100. In some embodiments a remote switch 118 can be connected to the driver circuit 108 by wires 120. The remote switch 118 can be placed in a convenient location that allows the user to activate or deactivate the driver circuit 108, as desired. In some embodiments, however, it is contemplated that a switch for activating and deactivating the driver circuit can be placed on the circuit board with the driver circuit 108.

The conductive prongs 110 and stabilizing prongs 112 are pointed at their distal ends so as to be able to pierce through the material of the hat 114. In some embodiments the hat 114 can be provided with slots 115 that allow the conductive prongs 110 to pass through the hat 114, and the conductive prongs 110 can be conductive tabs that have a flat shape and are made out of a malleable metal that can be bent to a different shape. The stabilizing prongs 112 can be rigid and cylindrical or otherwise have a cross section that is regular (e.g. hexagonal). As shown here the prongs 110, 112 can be disposed on the first side 106 of the back plate 102 at or near the edges of the back plate 102 to provide the greatest stability and resistance to turning or twisting.

The front housing 122 includes a back wall 124 and a side wall 126 that extends from the back wall 124 around the periphery of the back wall 124. The back wall 124 can be sized and shaped in correspondence with the back plate 102. Generally, the side wall 126 extends from the back wall 124 at a right angle to the back wall 124, and defines a front edge 128 at a forward perimeter of the side wall 126. The back wall 124 and side wall 126 define an interior volume 130 of the front housing 122, in which several elements are disposed, including a light element 132. The front edge 128 of the side wall 126 further defines a window or opening to the interior volume 130. The light element 132 can be, in some embodiments, a circuit board on which one or more light emitting diodes (LEDs) are arranged. The light element 132, upon the system 100 being assembled, receives an electric current from the driver circuit 108 and produces light that passes through a translucent cover member 138 that attaches to the front housing 122 at the front edge 128. A plurality of prong receptacles 134, 136 can be formed in the interior space 130 of the front housing 122 to receive the prongs 110, 112 from the back plate 102. The prong receptacles are therefore positioned in the interior volume 130 such that they correspond in position with a respective one of the prongs 110, 112. Further, the prong receptacles have a channel into which a prong entered, and the channel is open at the back wall 124 so that the prongs can pass into the channel in a respective prong receptacle. The prong receptacles 134, 136 can be configured for the specific shape of the prongs (e.g. either 110 or 112), and include features for retention by mechanical interference. In general, the front housing 122 can be a molded polymeric member in which the prong receptacles are integrally formed to receive additional elements for interfacing and retaining the prongs 110, 112.

The cover 138 is made of a translucent material and can have logo or other graphic design elements 140 arranged on a background 142. The cover 138 can be a molded member in which the design elements 140 are molded with various colors of polymeric material, or the design elements 140 can be formed in the front surface of the cover 138 and subsequently painted or otherwise colored. The cover 138 has features that interface with corresponding features at the front edge 128 of the front housing 122, or that are adjacent the front edge 128, and which releasably retain the cover 138 over the window defined by the front edge 128. Thus, the cover 138 must have a perimeter edge that matches the front edge 128 of the front housing 122. The cover 138 can be mounted on the front housing, such as by a snap fit action, at the front edge 128, in such a way that the cover 138 can be removed intact by a user, and replaced with another cover which can have a different design element 140.

In operation, a user can assemble the system 100 by, for example, placing the back plate inside a hat 114, in a position such that prongs 110, 112 pass through the material of the hat 114 at an appropriate location. The prongs 110, 112 will pass through the material of the hat 114 and extend beyond the opposite side of the hat 114. The front housing 122 can then be moved into a mating relationship with the back plate 102 by aligning the prongs 110, 112 with the openings at the back wall 124 of the front housing 122 corresponding to respective channels in prong receptacles 134, 136. In some embodiments the prong receptacles 134, 136 can be self-locking, meaning that while the prongs 110, 112 can be relatively easily pushed into the channels in the prong receptacles 134, 136, there is immediate resistance to the prongs 110, 112 being moved in the opposite direction (i.e. removed). In some embodiments, an additional step may be needed to lock the prongs 110 in place in the front housing 122. As such, the hat 114 will be captured between the back plate 102 and the front housing 122. A selected cover member 138 can be installed on the front housing 122, the foam cover 116 can be placed over the back plate 102 and driver circuit 108, and the switch 118 can be placed or located in an appropriate location in the hat as well. When the user operates the switch 118, current can flow from the driver circuit 108 (including a battery) through the prongs 110, and through the lighting element 132 to illuminate the cover member 138. The user can then change the cover member 138 for a different one, and wear that one for a different occasion, as the user desires.

Figure 2B:
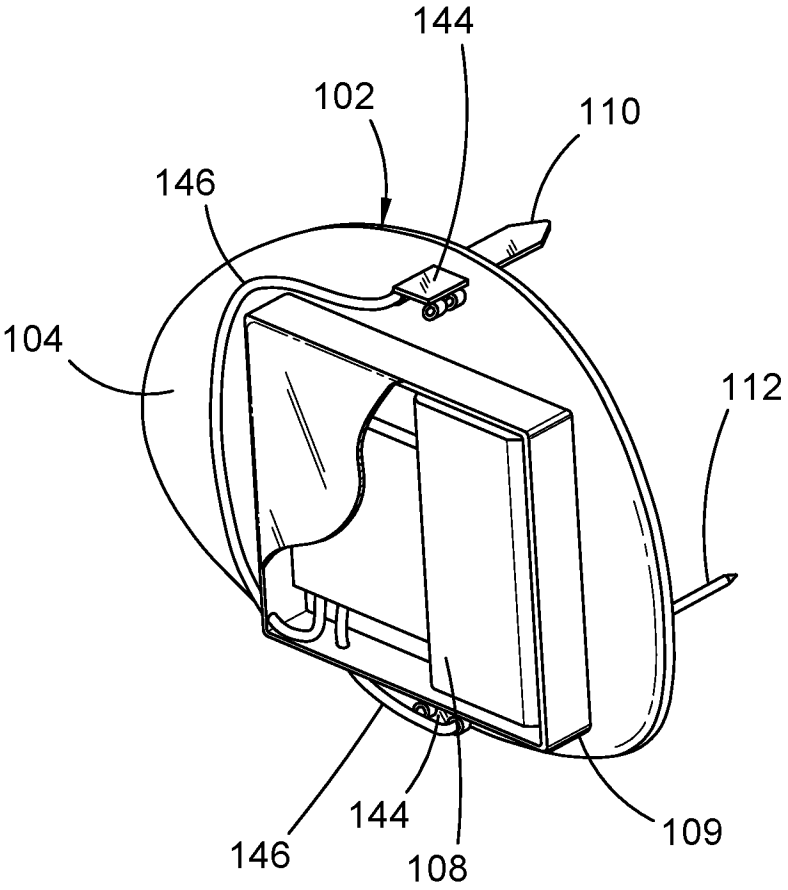
FIGS. 2A-2B show detailed views of a back plate for a lighted display system for a hat, in accordance with some embodiments.
Figure 2A:
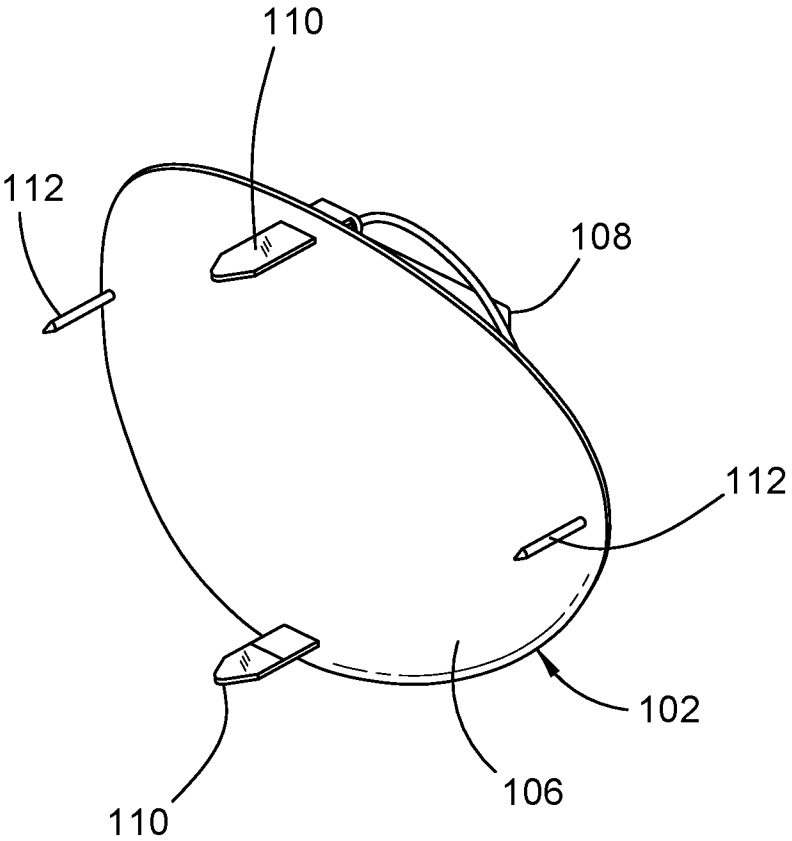

FIGS. 2A-2B show detailed views of a back plate 102 for a lighted display system for a hat, in accordance with some embodiments. Specifically the first side 106 is seen in isometric view in FIG. 2A, and the second side 104 is seen in FIG. 2B. It can be seen that the driver circuit 108 can be disposed in a container 109 or under a cover to protect the driver circuit from exposure to moisture and debris. The driver circuit 108 is coupled electrically to conductive prongs 110, which have a connecting portion 144 on the second side 104 of the back plate 102 that can receive a wire or similar current carrier. The support prong 112 do not need to be connected to the driver circuit 108, but are mounted in the back plate 102 such as by passing through the back plate 102 and having a flat head on the second side 104 that prevents the support prong 112 from falling off of from the back plate 102.

Figure 3B:
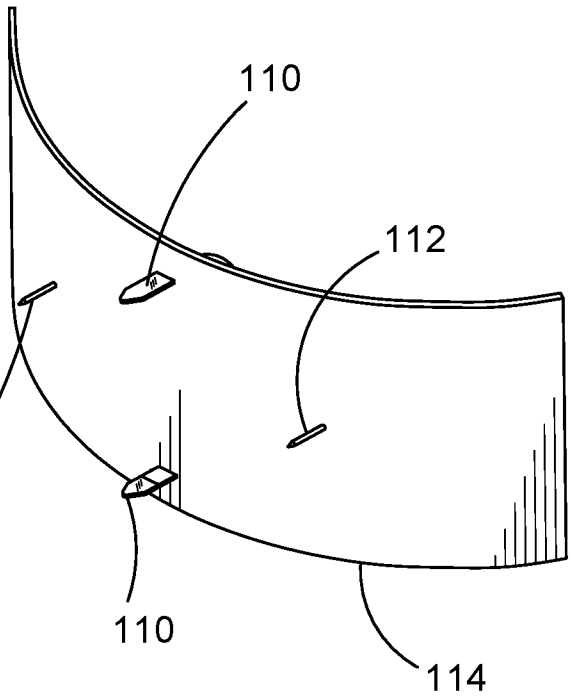
FIGS. 3A-3C show a sequence for partially assembling a lighted display system into a hat, in accordance with some embodiments.
Figure 3A:
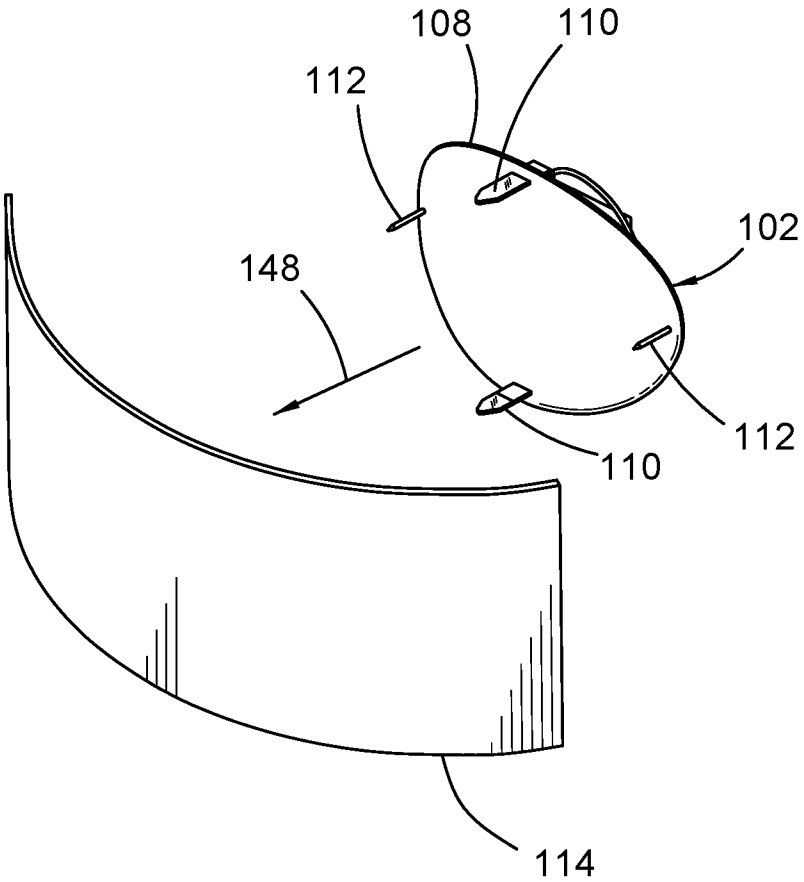
Figure 3C:
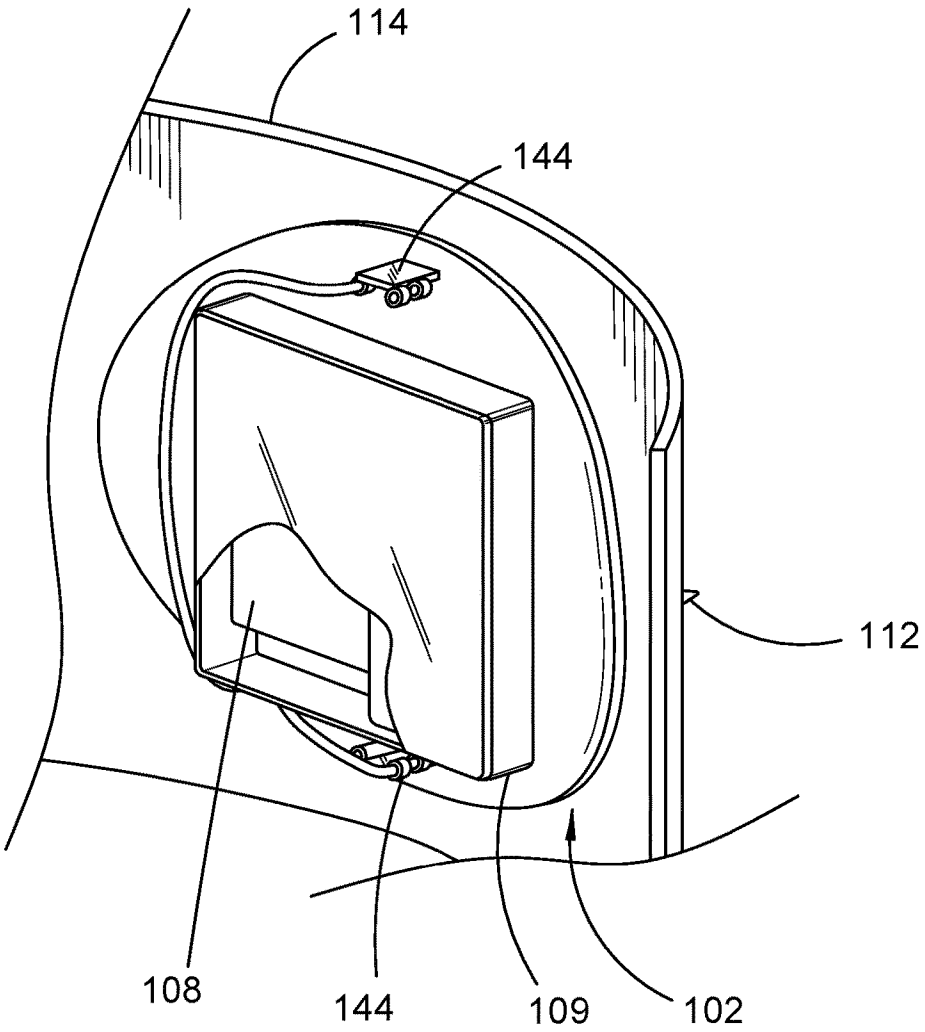

FIGS. 3A-3C show a sequence for partially assembling a lighted display system into a hat 114, in accordance with some embodiments. In FIG. 3A the back plate is separated from the hat 114 and moved into a desired position inside the hat 114. Conductive prongs 110 can pass through slots provided, or otherwise created in the hat 114, while support prongs 112 can pierce through the material of the hat 114. In FIG. 3B the back plate 10 has been moved into contact with the inside of the hat 114, and the prongs 110, 112 extend through the hat 114 and out from the outside of the hat 114. FIG. 3C shows a reverse view from that of FIGS. 3A-B, and shows the back plate 102 up against the inside of the hat 114.

Figure 4B:
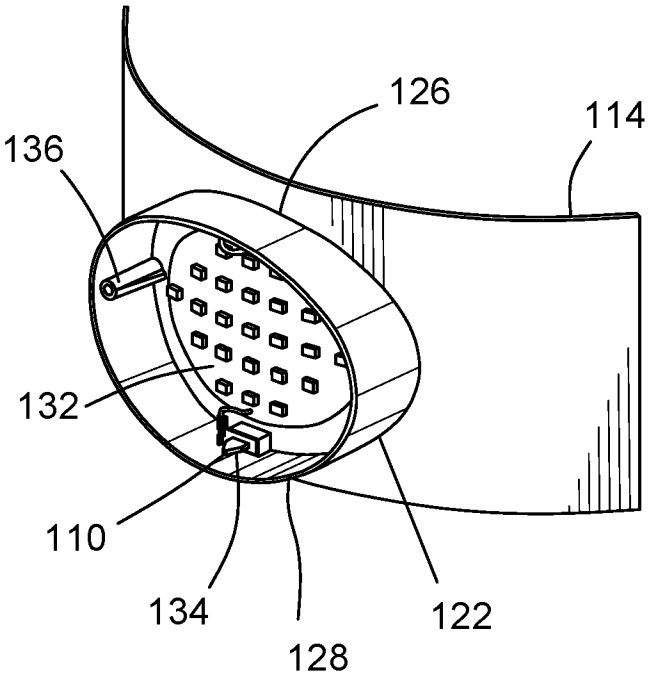
FIGS. 4A-4C show a sequence for partially assembling a lighted display system into a hat, in accordance with some embodiments.
Figure 4A:
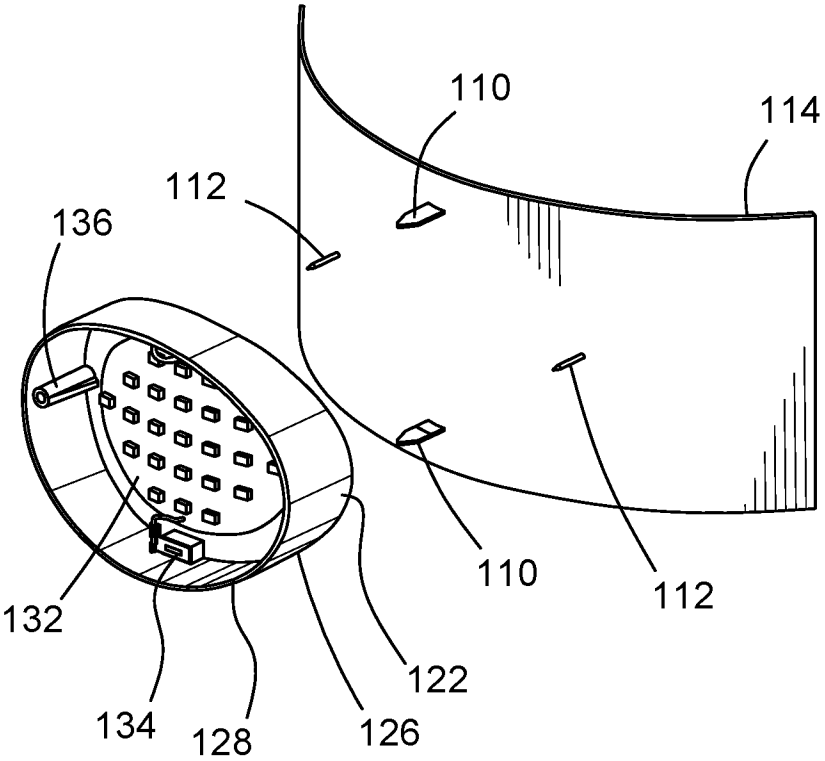
Figure 4C:
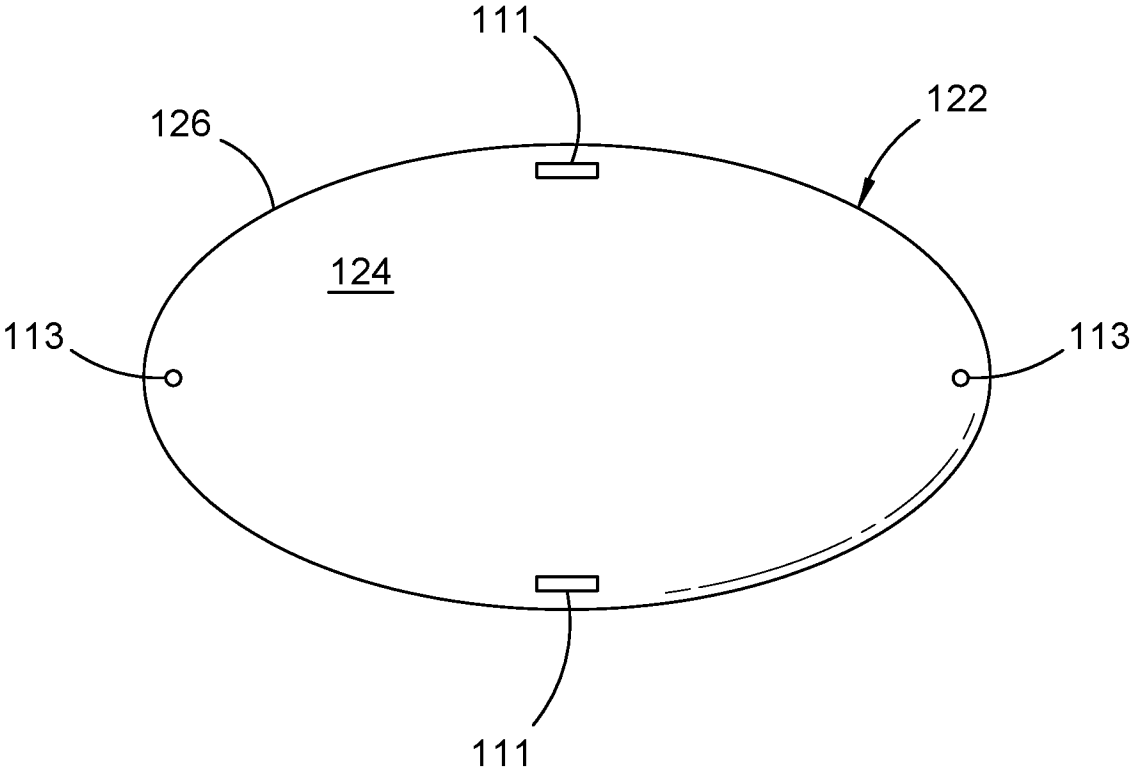

FIGS. 4A-4B show a sequence for partially assembling a lighted display system into a hat 114, in accordance with some embodiments. In particular, the sequence of FIGS. 4A-4B follows the sequence of FIGS. 3A-3B, and shows how the front housing 122 is then mounted onto the prongs 110, 112 at the outside of the hat 114. In FIG. 4A, the back wall 124 of the front housing 122 is exposed, as seen in FIG. 4C. Openings 111 and 113 are formed that pass through the back wall 124 and into prong receptacles in the interior volume 130 of the front housing 122. Openings 111 are sized to receive the conductive prongs 110, and openings 113 are sides to receive the support prongs 112. In FIG. 4B the front housing is moved into contact with the outside of the hat 114, and it can be seen that prong receptacles 134 are sized such that the distal end of the conductive prongs 110 extend beyond an end of the prong receptacle 134. However, the support prong receptacle 136 completely covers the support prong 112. The prong receptacles 134, 136 are formed as boss elements which extend from the inside of the back wall 124 along the inside of the side wall 126.

Figure 5B:
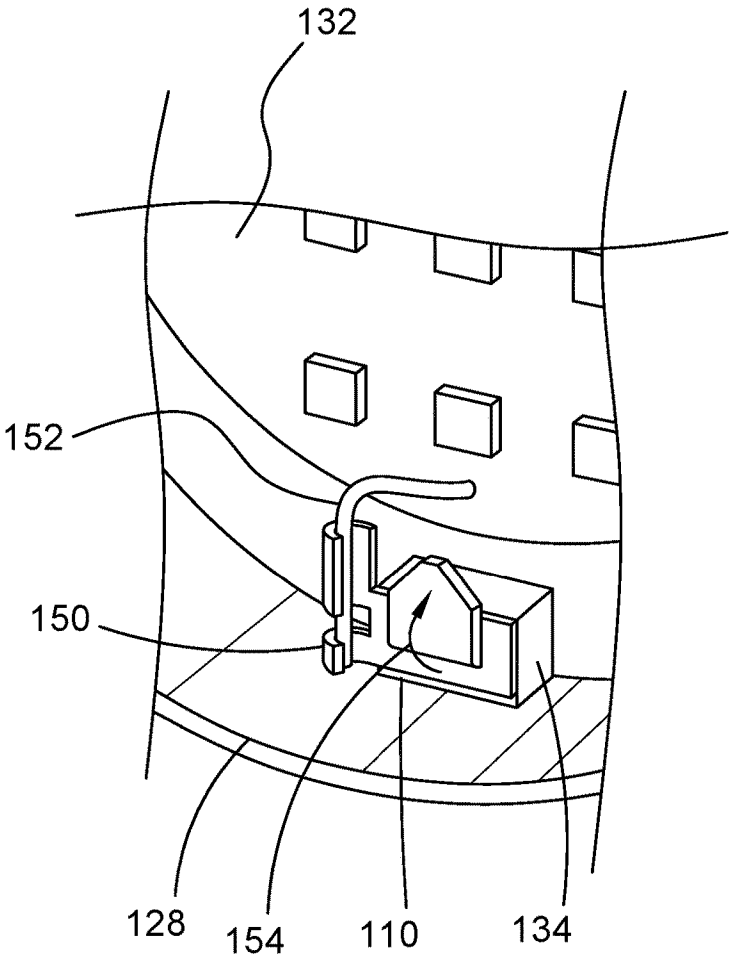
FIGS. 5A-5B show a sequence for partially assembling a lighted display system into a hat, in accordance with some embodiments.
Figure 5A:
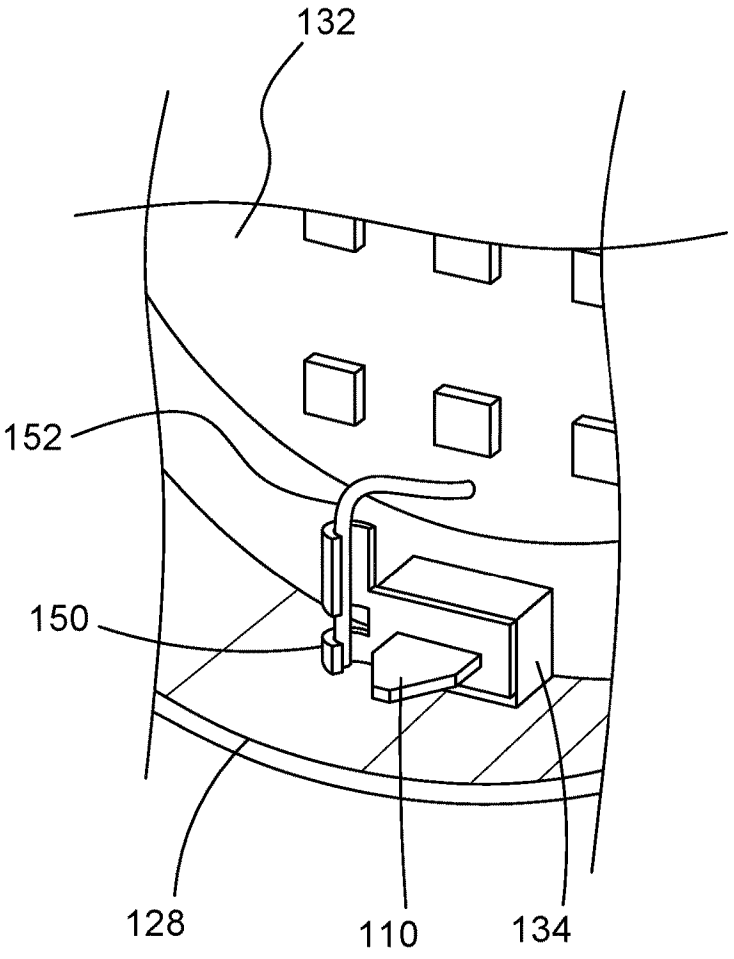

FIGS. 5A-5B show a sequence for partially assembling a lighted display system into a hat, in accordance with some embodiments. The sequence of FIGS. 5A-B follows the sequence of FIGS. 4A-B where the conductive prongs 110 extend beyond their respective prong receptacle 134. In FIGS. 5A-B a connector element 150 is shown at the end of the prong receptacle 134, and is connected to a wire 152 that is further connected to the light element 132. In FIG. 5A the distal end of the conductive prong 110 is still straight with respect to the rest of the conductive prong 110 inside the prong receptacle 134. In FIG. 5B the distal end of the conductive prong 110 is bent upwards, as indicated by arrow 154, into contact with the connector element 150, which retains the back plate 102 and front housing 122 together, with the hat 114 sandwiched between them, and ensure electrical contact between the conductive prong 110 and the connector element 150.

Figure 6A:
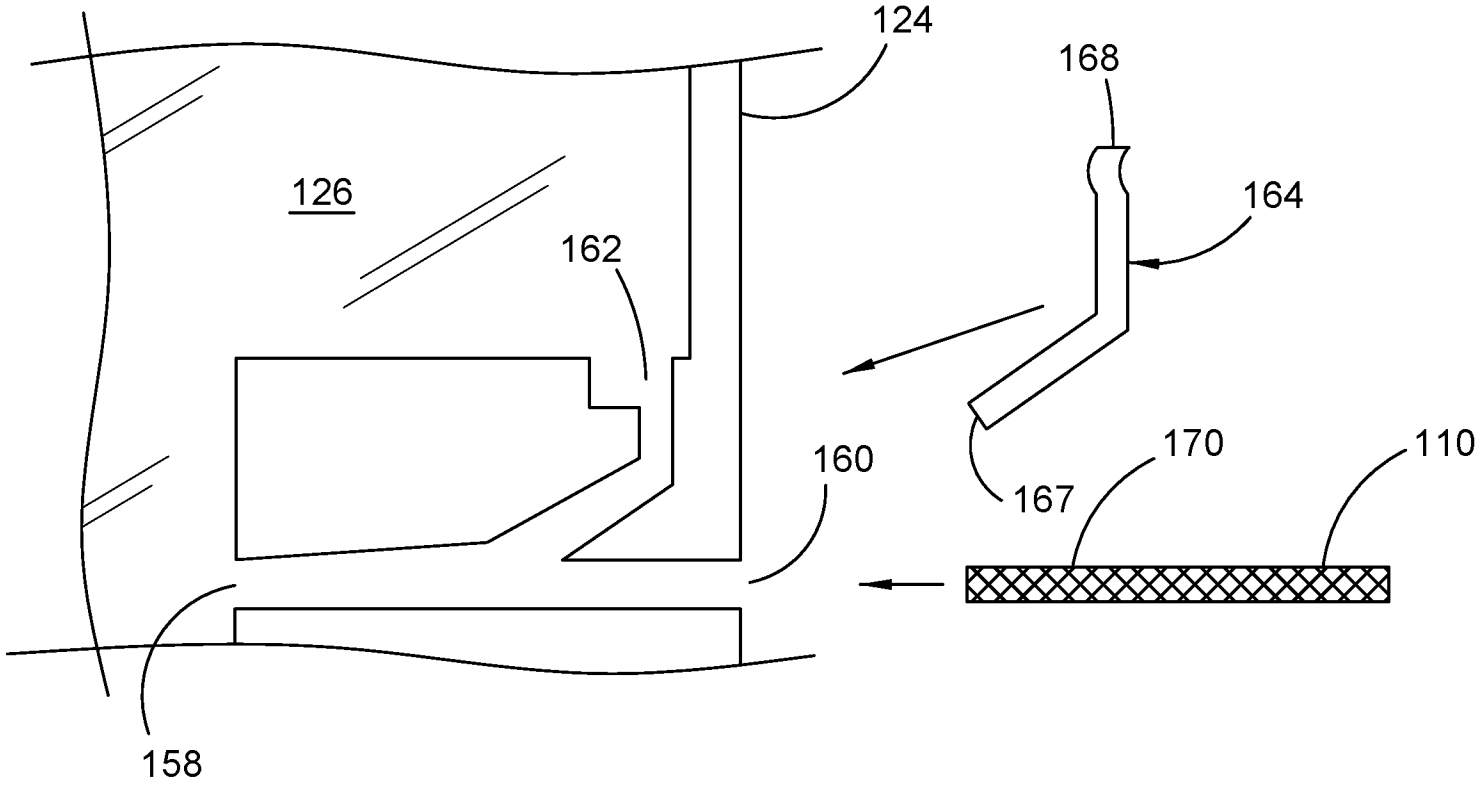
FIG. 6A shows a side view of a prong receptacle for receiving a conductive prong in a lighted display system for a hat, in accordance with some embodiments.
Figure 6B:
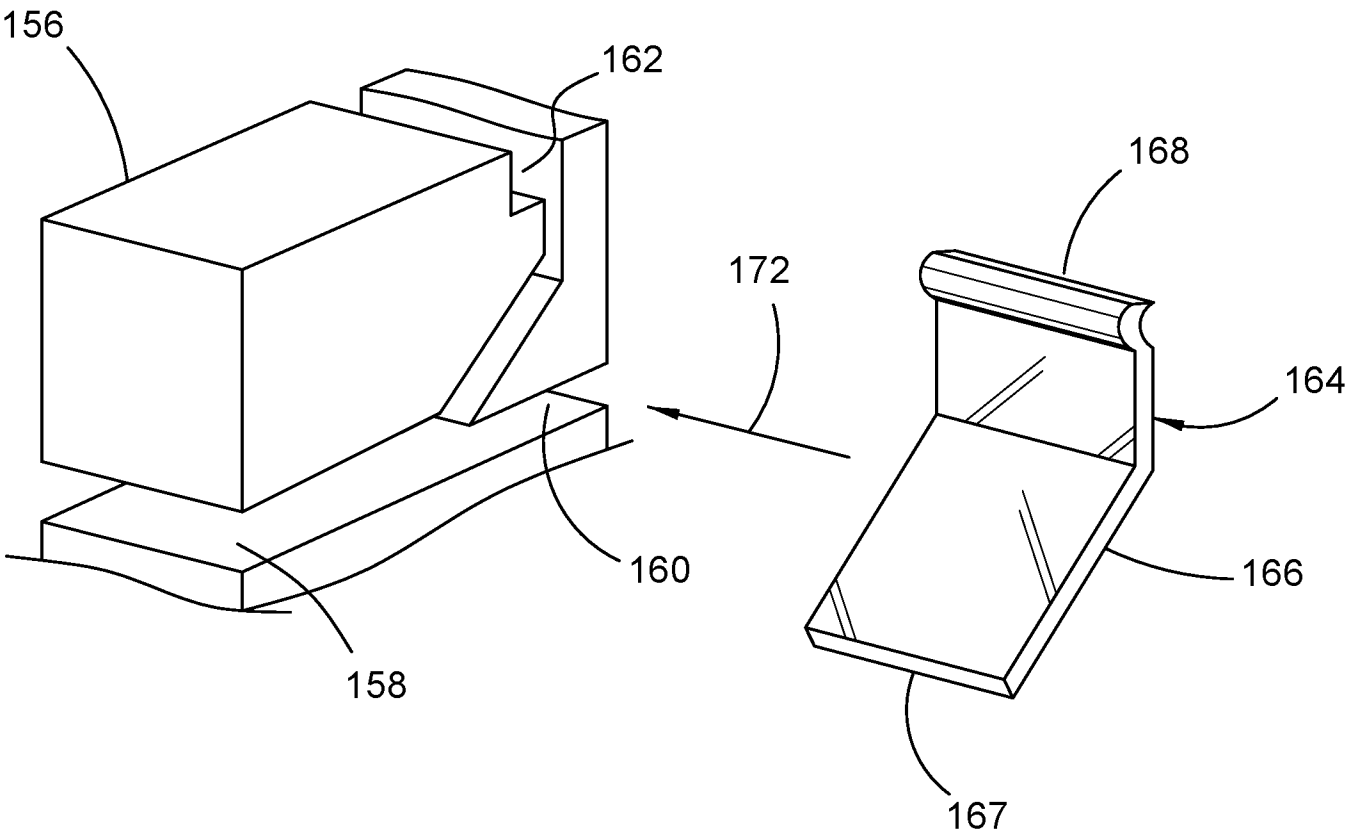
FIG. 6B shows an isometric view a prong receptacle for receiving a conductive prong in a lighted display system for a hat, in accordance with some embodiments.
Figure 6C:
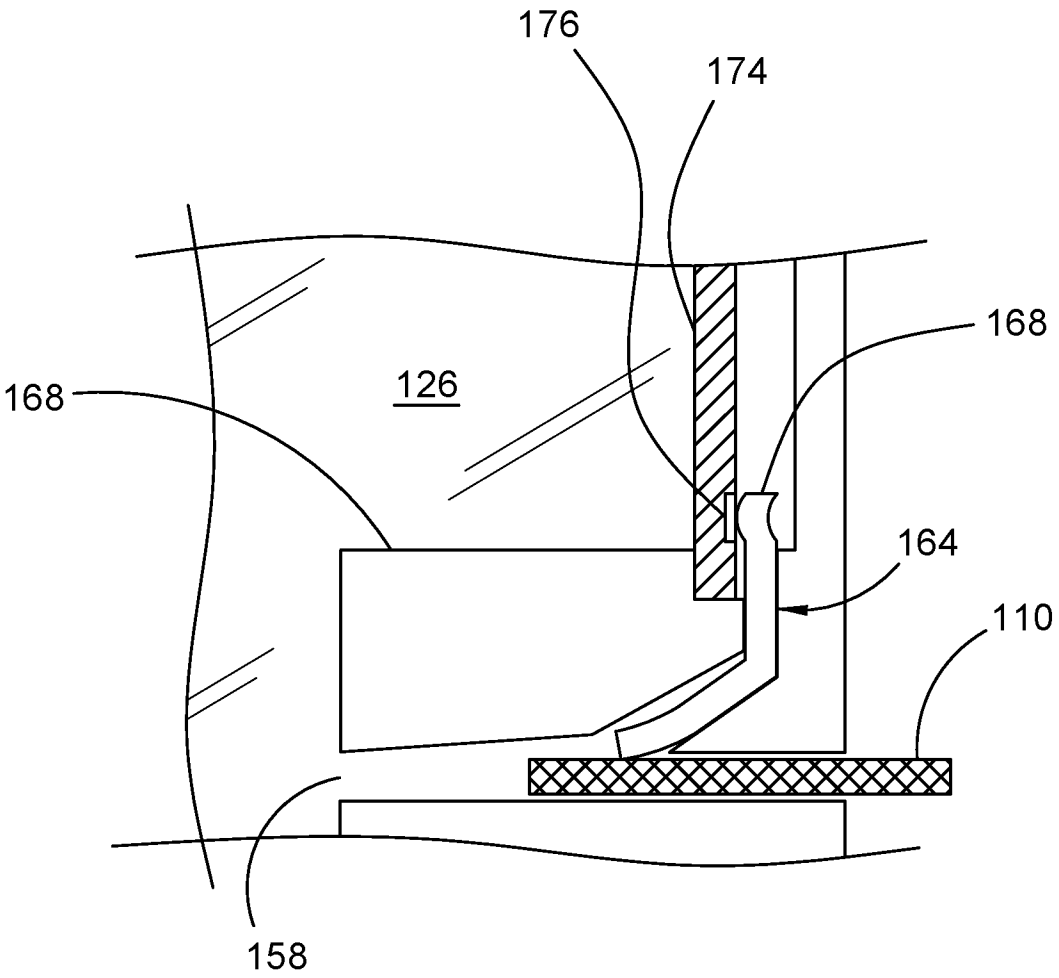
FIG. 6C shows a prong receptacle with a prong inserted therein in a lighted display system for a hat, in accordance with some embodiments.

FIG. 6A shows a side view of a prong receptacle for receiving a conductive prong in a lighted display system for a hat, in accordance with some embodiments. In general, FIGS. 6A-6C show an alternative design for a prong receptacle 156 that is configured to receive a conductive prong 110. The prong receptacle 156 provide a similar function as that of prong receptacle 134 in previous drawings. The prong receptacle 156 defines a channel 158 that is contiguous with an opening (e.g. 111) through the back wall 124 of the front housing 102. The prong receptacle 156 also includes retainer slot 162 into which a retainer clip 164 is inserted. The retainer clip 164 is metallic and electrically conductive and has an upper portion that has a head 168, and a lower portion 166 that extend into the channel 158 so that a bottom end 167 makes contact with the top surface 170 of the conductive prong 110. At the same time, the bottom end 167 is an edge (e.g. a corner), and the direction of the bottom portion 166 relative to channel 158 creates an interference that more easily allows the conductive prong 110 to be pushed past the bottom end 167 when the conductive prong 110 is being inserted into the channel 158, than the bottom end 167 allows the conductive prong 110 to be withdrawn from the channel 158. In FIG. 6B the retaining clip 164 is shown to the side of the prong receptacle 156 in an isometric view, and is aligned with retainer slot 162. By moving the retaining clip 164 into the slot 162, as indicated by arrow 172, the retaining clip will be operative to act as both a retaining feature and electrical connector. In FIG. 6C, which shows a side view similar to that of FIG. 6A, the retaining clip 164 is in the retaining slot (162), and the bottom end 167 of the retaining clip 164 is deflected due to contact with the top surface 170 of the conductive prong 110 having been inserted into the channel 158. IN addition, the top of the retaining slot 162 includes a shoulder into which an edge of a circuit board 174 can be inserted. The circuit board 174 can have one or more lighting elements, such as LEDs, disposed on the outward facing side of the circuit board 174. Further, the circuit board 174 can have a conductive pad 176 that is pressed into contact with the head 168 of the retaining clip 164, which has a forward deviation. The circuit board 174 is held, due to the dimensions of the shoulder, such that the pad 176 presses against the forward deviation of the head 168 and urges it rearward, ensuring a constant pressure between the forward deviation and the pad 176. As the retaining clip is electrically conductive, it acts as a connector between the conductive prong 110 and the circuit board 174. A similar arrangement at the top of the front housing 102 can act to capture the circuit board 174 in the front housing 102 in conjunction with the structure shown in FIGS. 6A-C.

Figure 7:
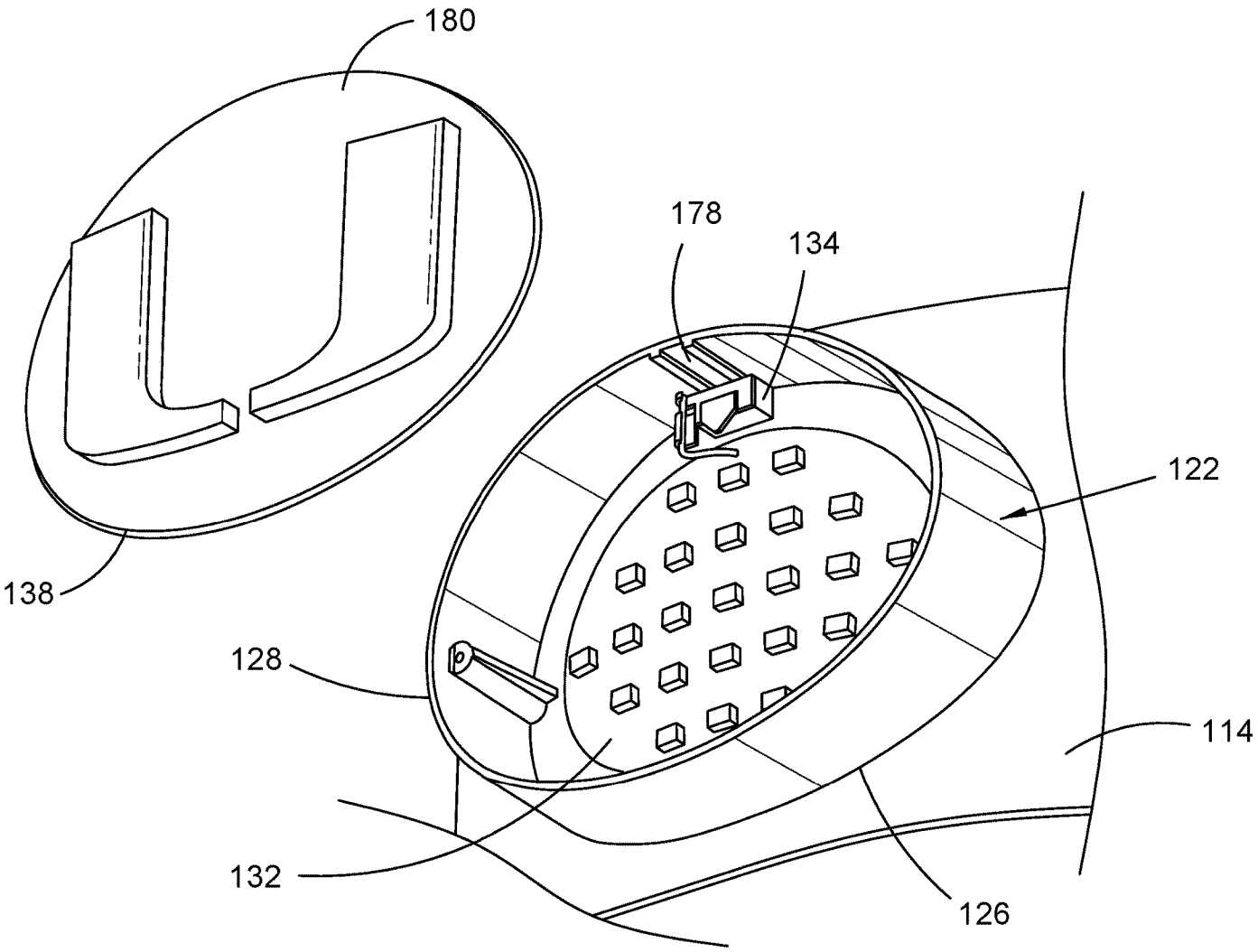
FIG. 7 shows an isometric exploded view of a front housing for a lighted display system for a hat, in accordance with some embodiments.

FIG. 7 shows an isometric exploded view of a front housing 122 for a lighted display system for a hat, in accordance with some embodiments. A cover member 138 fits over or into the opening at the front of the front housing defined by the front edge 128, and is releasably retained by, for example, interfering retentions features 178 in the front housing that catch a corresponding feature 180 on the cover member 138. The cover member 138 can be removed by a user by actuating, for example, a latch. The user can then attach a different cover member to the front housing 122 as desired.

Figure 8:
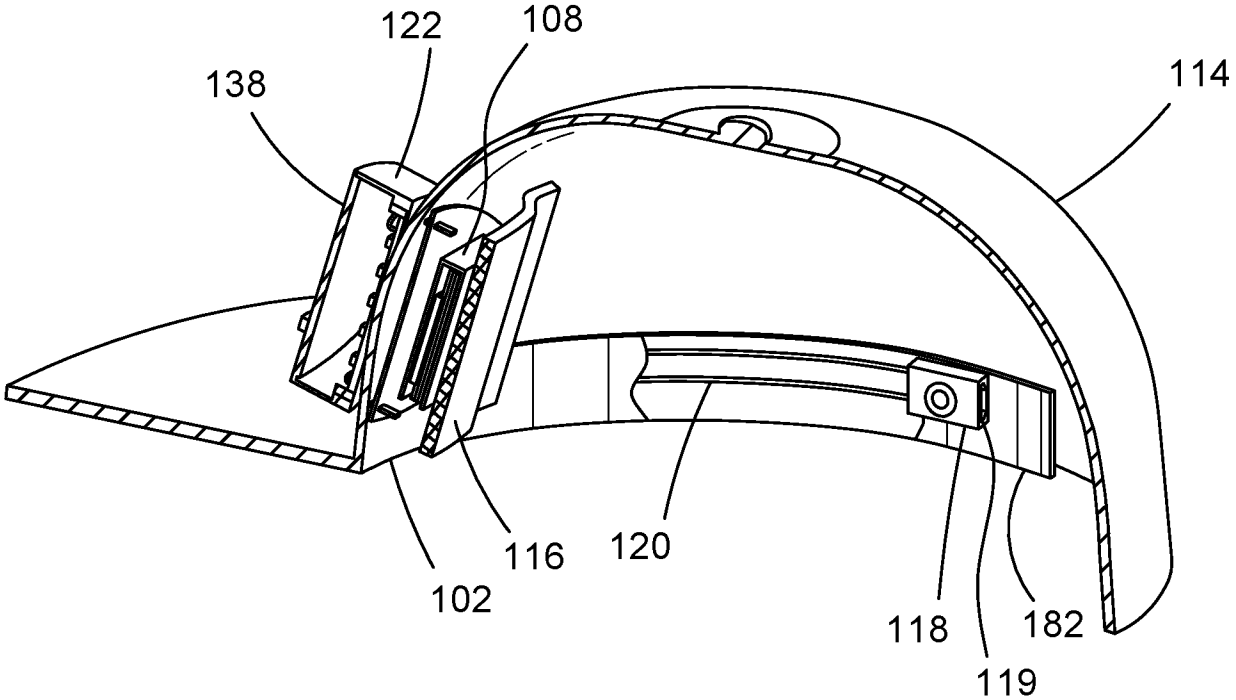
FIG. 8 shows a side cut-away view of a hat having a lighted display system, in accordance with some embodiments.

FIG. 8 shows a side cut-away view of a hat 114 having a lighted display system, in accordance with some embodiments. The hat 114 shown here is a baseball type cap having a front with a brim, as is well known. Other types of hats can likewise serve as a base for supporting the lighted display assembly. In the hat 114 a back plate 102 is located on the inside of the hat 114, and carries a driver circuit 108 that is covered by a pad 116. Prongs including conductive prongs on the back plate 102 pass through the front of the hat 114 to mate with a front housing 122, in which a light element is disposed that is powered by the driver circuit 108. A cover member 138 can thereby be illuminated. The driver circuit 108 is coupled to a switch 118 by wires 120. The switch 118 can be located on the lower side of the hat 114 for ease of access while wearing the hat 114. A connector 119 can be located in the end of the housing of the switch 118 to allow recharging of the battery. The connector 119 can be, for example, a micro USB connector, as is commonly used on cellular telephone devices. A protective cover 182 can be placed over the wires 120 and switch 118. The cover 182 is a strip of material that can act as a moisture barrier to prevent sweat from affecting the wires 120 and switch 118.

In some embodiments, the switch 118 controls the state of operation of the driver circuit 108. For example, from an off state, the button of the switch 118 can be pushed once to turn the LEDs on continuously. Pressing the button again advances the operational state to, for example, a blinking state where the driver circuit alternatively turns the LEDs on and off. In another state, a microphone connected to the driver circuit can be used to detect a periodic audio signal, such as in music, and the driver circuit can synchronize activation and de-activation of the LEDs with the periodic audio signal. After cycling through the various operational states of the driver circuit, a final state can be an "off" state where the LEDs are left off, and the driver circuit monitors the switch 118 to detect button presses.

Figure 9:
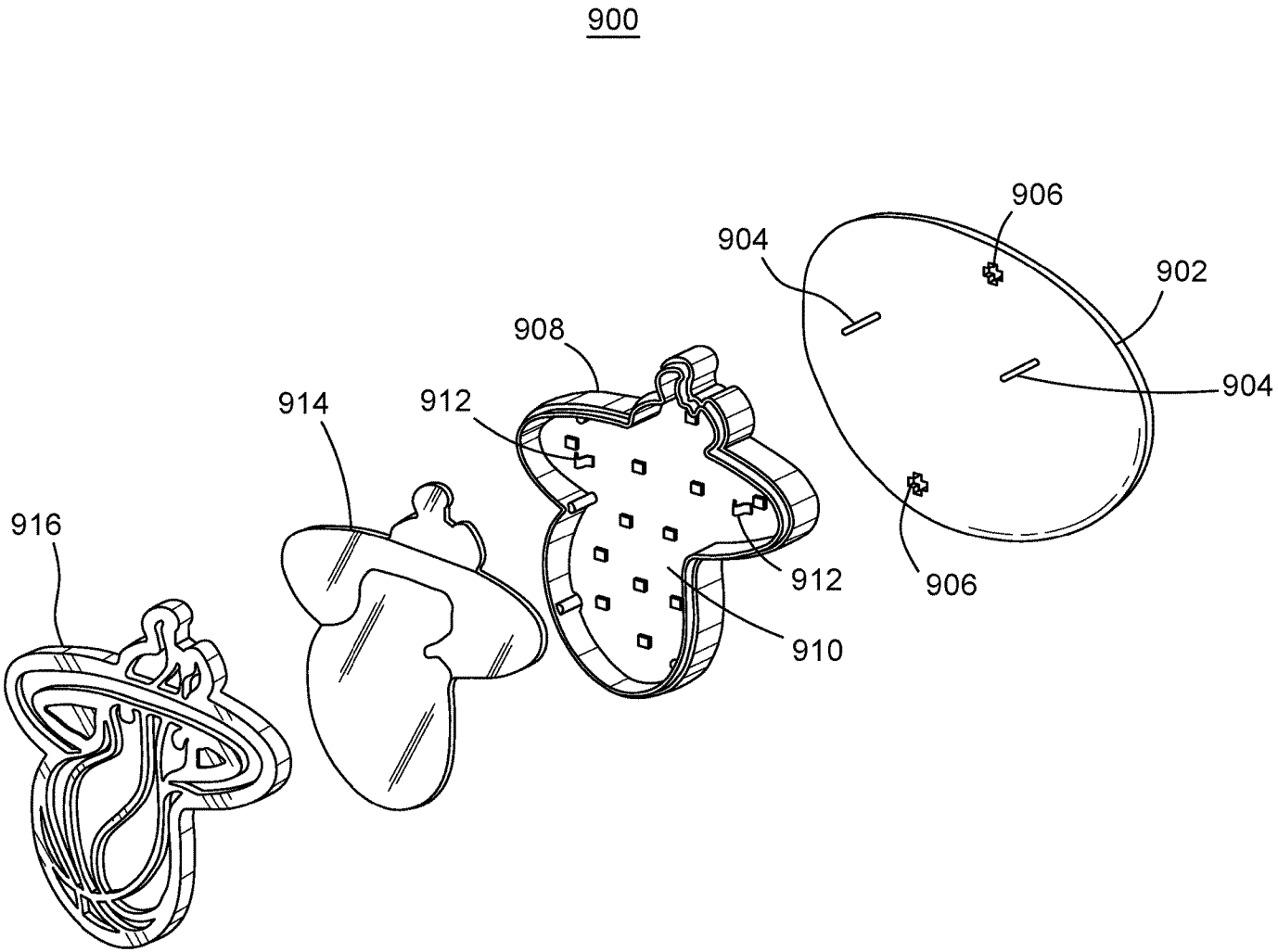
FIG. 9 shows an exploded view of a lighted display system for a hat, in accordance with some embodiments.

FIG. 9 shows an exploded view of a lighted display system 900 for a hat, in accordance with some embodiments. The system 900 is similar to that of FIG. 1, and includes a back plate 902 that is designed to be placed on the inside of the hat (as shown in FIG. 1), and provide electric power to circuitry in a front housing 908, that is positioned on the outside of the hat, and positioned in correspondence with the back plate 902. The back plate 902 include a pair of prongs 904 to carry electricity to and from the circuitry in the front housing 908. Thus, the prongs 904 pass through the hat and mate with connectors 912 in the front housing 908. The back plate 902 further includes retention holes 906 that receive mating retention posts 920 on the back of the front housing 908, as is shown in FIG. 10.

The front housing 908 is shaped to have an outline corresponding to that of a logo or other known design. As shown here, the front housing 908 is formed to have a shape that matches the outline of a professional basketball team. The front housing 908 include a back wall and a side wall that extends forward from the back wall around the perimeter of the back wall. Inside the front housing 908 is a circuit board 910 on which a plurality of LEDs is mounted, along with the connectors 912. The circuit board can further comprise driver circuitry for operating the LEDs. For example, the LEDs can be operated in any of several modes, including low, high, blinking, and so on. A switch can be provided on the side of the front housing 908 to control operation of the lighting mode. The circuit board 910 can be formed in the shape of the outline of the front housing 908. A front edge 918 of the side wall of the front housing is formed to receive and retain a front cover 916 and capture a translucent color plate 914 between the front housing 908 and the cover 916. The cover plate 914 is formed to allow light from the LEDs on the circuit board 910 to pass through and illuminate the cover plate 914. Preferably, the cover 916 and front housing 908 are designed such that they "snap" together using well-known retention features.

Figure 10:
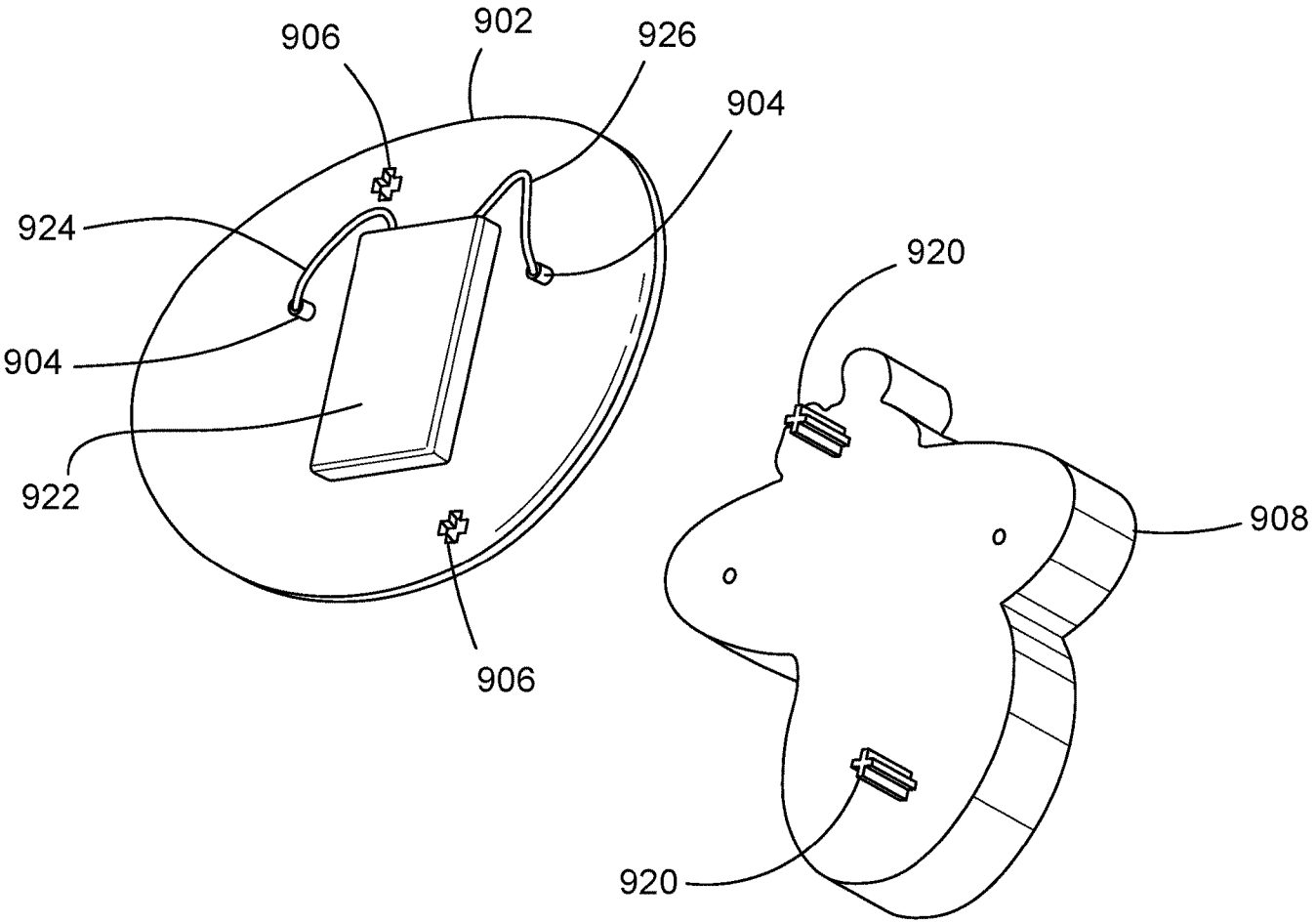
FIG. 10 shows a reverse exploded view of the lighted display system of FIG. 9.
Figure 11:
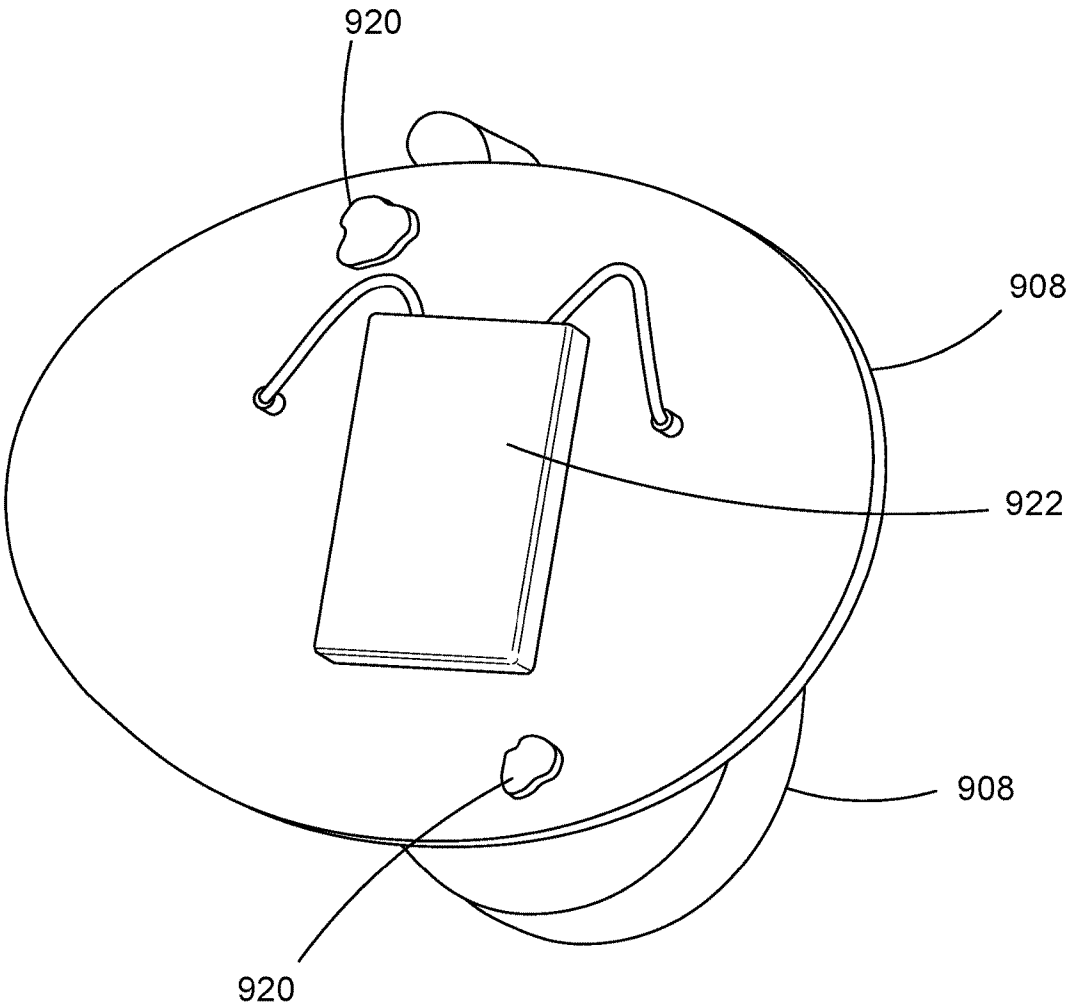
FIG. 11 shows a reverse assembled view of the light display system of FIG. 9.

FIG. 10 shows a reverse exploded view of the lighted display system of FIG. 9, and the back side of the back plate 902 can be seen. A battery 922 is mounted on the back side of the back plate 902, and is connected to the prongs 904 by wires 924, 926. The battery 922 can be mounted using retention clip features, or it can be simply adhered to the back plate 902. Retention posts 920 on the back side of the back wall of the front housing 908 are positioned to correspond with retention holes 906 in the back plate 902. When assembled, the retention posts 920 pass through the retention holes 906, and are melted over, or otherwise deformed, as shown in FIG. 11, to permanently mount the system 900 on a hat.

Figure 12B:
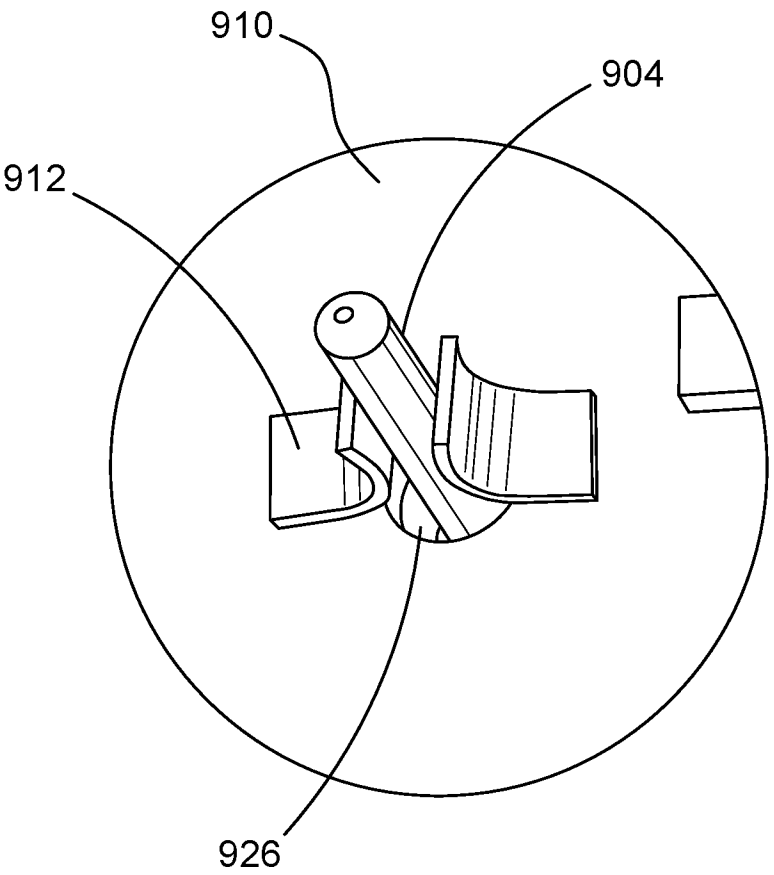
FIGS. 12A and 12B show a detail of an electrical connection of the lighted display system of FIG. 9.
Figure 12A:
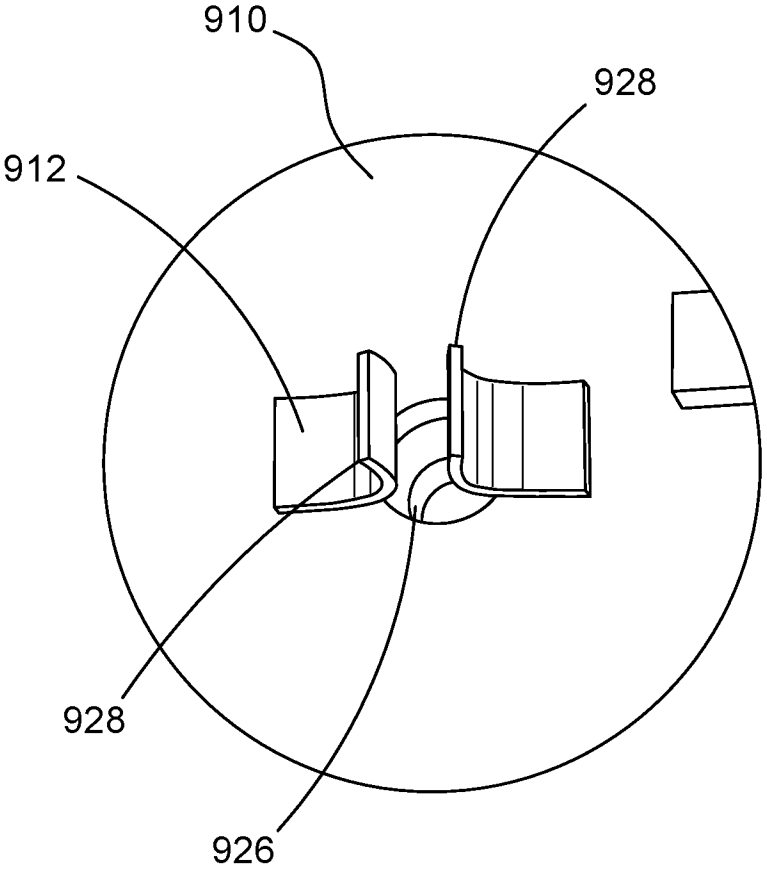

FIGS. 12A and 1B show a detail of an electrical connection of the lighted display system 900 of FIG. 9. Connectors 912 (prong receptacles) comprise opposing reed members 928 positioned in an opposing manner around and over an opening 926 through the circuit board 910. The reed members 928 are electrically conductive and form a gap between them that is less than the diameter of the conductive prongs. The reed members further extend upward from the surface of the circuit board 910 and are angled toward each other. Further, the reed members 928 are electrically connected to conductive traces in the circuit board 910. In FIG. 12B the system 900 is assembled, and a prong 904 is seen passing through the opening 926 and deflecting the reed members 928 of the connector 912, thereby making electrical contact.

A lighted display system for a hat or other garment has been disclosed that allows a user to have, and change out cover members that can have different designs. This allows the user to select a cover member having a design that is relevant to an event, or simply displays a design of interest to the wearer. A front housing interfaces with a back plate that carries a driver circuit. The mating features include conductive prongs that both mechanically act to retain the front housing and back plate together and carry current between the driver circuit and the light element in the front housing. A switch allows the user to selectively activate and deactivate the driver circuit, and thereby the illumination of the selected cover member.

What is claimed is:

1. A light assembly for a hat, the light assembly having a changeable display element that is illuminated by the light assembly, comprising:

a back plate configured to be mounted inside the hat, the back plate having:

a first side and a second side;

a plurality of conductive prongs extending from the first side;

a driver circuit board disposed on the second side that is electrically connected to at least two of the plurality of prongs;

a front housing having:

a back wall;

a sidewall extending forward from the back wall, the sidewall defining a front window and front edge at a forward perimeter of the side wall;

the sidewall and the back wall defining an interior space;

a plurality of prong receptacles formed in the interior space, each one of the prong receptacles defining a channel through the back wall that is configured to receive a corresponding one of the plurality of conductive prongs and having a conductive contact configured to make electrical contact with a received conductive prong passing into the channel;

a light circuit board disposed in the interior space adjacent the back wall and having a light emitting element disposed thereon, wherein the light emitting element is electrically connected to at least two of the prong receptacles; and a cover retention feature at the front edge of the side wall configured to retain a cover over the window.

2. The light assembly of claim 1, wherein the plurality of conductive prongs and the plurality of prong receptacles are configured such that when the back plate and front housing are aligned and pressed together, with each of the plurality of conductive prongs passing into a respective one of the plurality of prong receptacles, a distal end of each of the plurality of prongs extends beyond an exit of the respective one of the prong receptacles, and wherein the conductive contact of each prong receptacle is located at the exit, and wherein electrical contact is made by bending the distal end of each of the conductive prongs into contact with the electrical contact.

3. The light assembly of claim 1, further comprising at least one support prong extending from the first side of the back plate that interfaces with a prong receptacle in the front housing at an opening at the back wall of the front housing.

4. The light assembly of claim 1, further comprising a switch electrically coupled to the driver circuit that is operable to activate and deactivate the driver circuit, the switch being coupled by wires that allow the switch to be remotely located in the hat from the driver circuit.

5. The light assembly of claim 1, further comprising a pad that is configured to cover the driver circuit.

6. The light assembly of claim 1 further comprising a rigid cover that is disposed over the driver circuit.

7. The light assembly of claim 1, wherein the back plate is curved.

8. The light assembly of claim 1, wherein each of the prong receptacles includes a retaining clip disposed in a slot in the prong receptacle, the retaining clip being conductive and having a bottom end that extends into the channel so as to be in contact with the respective conductive prong.

9. A light assembly for a hat, comprising:

a back plate configured to be mounted inside the hat, the back plate having a plurality of conductive prongs extending from a first side of the back plate and a power course electrically coupled to two of the plurality of conductive prongs;

a front housing having a back wall, a sidewall extending forward from the back wall, the sidewall defining a front window and front edge at a forward perimeter of the side wall, the sidewall and the back wall defining an interior space;

a light circuit board disposed in the interior space adjacent the back wall and having a light emitting element disposed thereon, the light circuit board further including a plurality of prong receptacles, each one of the prong receptacles defining an opening through the light circuit board that is configured to receive a corresponding one of the plurality of conductive prongs and having a conductive contact configured to make electrical contact with a received conductive prong passing through the opening, wherein the light emitting element is electrically connected to at least two of the prong receptacles; and a cover configured to fit over the front of the front housing that includes a translucent cover member.

10. The light assembly of claim 9, wherein the plurality prong receptacles include opposing reed members positioned around the respective opening for each one of the plurality of prong receptacles.

11. The light assembly of claim 9, wherein the plurality of conductive prongs and the plurality of prong receptacles are configured such that when the back plate and front housing are aligned and pressed together, with each of the plurality of conductive prongs passing into a respective one of the plurality of prong receptacles, a distal end of each of the plurality of prongs extends beyond an exit of the respective one of the prong receptacles, and wherein the conductive contact of each prong receptacle is located at the exit, and wherein electrical contact is made by bending the distal end of each of the conductive prongs into contact with the electrical contact.

12. The light assembly of claim 9, wherein the back plate comprises at least two retention holes, the front housing includes at least two retention posts at a back side of the front housing, wherein each one of the at least two retention posts is positioned to correspond with a respective one of the retention holes in the back plate.

13. The light assembly of claim 12, wherein each of the retention posts pass through the respective one of the retention holes and is melted over on a back side of the back plate to retain the back plate to the front housing.

14. The light assembly of claim 9, wherein the front housing have cover have a shape that corresponds to an outline of a logo.

15. The light assembly of claim 9, wherein the cover and translucent cover member are removable from the front housing.

* * * * *